US006898949B2

(12) United States Patent
Paradowski

(10) Patent No.: US 6,898,949 B2
(45) Date of Patent: May 31, 2005

(54) METHOD FOR REFRIGERATING LIQUEFIED GAS AND INSTALLATION THEREFOR

(75) Inventor: Henri Paradowski, Cergy (FR)

(73) Assignee: Technip France (FR)

( * ) Notice: Subject to any disclaimer, the term of this patent is extended or adjusted under 35 U.S.C. 154(b) by 13 days.

(21) Appl. No.: 10/451,712

(22) PCT Filed: Dec. 13, 2001

(86) PCT No.: PCT/FR01/03983

§ 371 (c)(1),
(2), (4) Date: Nov. 3, 2003

(87) PCT Pub. No.: WO02/50483

PCT Pub. Date: Jun. 27, 2002

(65) Prior Publication Data

US 2004/0065113 A1 Apr. 8, 2004

(30) Foreign Application Priority Data

Dec. 18, 2000 (FR) ..... 00 16495

(51) Int. Cl.[7] ..... F25J 1/00; F25J 3/00
(52) U.S. Cl. ..... 62/613; 62/614; 62/621
(58) Field of Search ..... 62/611, 612, 613, 62/614, 620, 621, 623

(56) References Cited

U.S. PATENT DOCUMENTS 3,503,220 A * 3/1970 Desai ..... 62/613
3,616,652 A 11/1971 Engel ..... 62/11
3,677,019 A * 7/1972 Olszewski ..... 62/613
4,548,629 A * 10/1985 Chiu ..... 62/621
6,023,942 A 2/2000 Thomas et al. ..... 62/613
6,289,692 B1 * 9/2001 Houser et al. ..... 62/613
6,449,984 B1 * 9/2002 Paradowski ..... 62/613

FOREIGN PATENT DOCUMENTS

DE 3822175 1/1990
FR 2682964 4/1993

* cited by examiner

*Primary Examiner*—William C. Doerrler
(74) *Attorney, Agent, or Firm*—Ostrolenk, Faber, Gerb & Soffen ,LLP

(57) ABSTRACT

The invention concerns a method for refrigerating liquefied natural gas under pressure (1), comprising a first step wherein the LNG (1) is cooled, expanded and separated (a) in a first base fraction (4) which is collected, and (b) a first top fraction (3) which is heated, compressed in a compressor (K1) and cooled into a first compressed fraction (5) which is collected; a second compressed fraction (6) is drawn from the fuel gas (5), cooled then mixed with the cooled and expanded LNG (1). The invention is characterised in that it comprises a second step wherein the second compressed fraction (6) is compressed and cooled, and a flux is (8) drawn and cooled, expanded and introduced in the compressor (K1). The invention also describes other embodiments.

12 Claims, 7 Drawing Sheets

METHOD FOR REFRIGERATING LIQUEFIED GAS AND INSTALLATION THEREFOR

The present invention relates, in general, and according to a first of its aspects, to the gas industry and, in particular, to a method for refrigerating pressurized gas containing methane and C2 and higher hydrocarbons, so as to separate them.

More specifically, the invention relates, according to its first aspect, to a method for refrigerating a pressurized liquefied natural gas containing methane and C2 and higher hydrocarbons, comprising a first step (I) in which step (Ia) said pressurized liquefied natural gas is expanded to provide an expanded liquefied natural gas stream, in which step (Ib) said expanded liquefied natural gas is split into a relatively more volatile first top fraction and a relatively less volatile first bottom fraction, in which step (Ic) the first bottom fraction consisting of refrigerated liquefied natural gas is collected, in which step (Id) the first top fraction is heated, compressed in a first compressor and cooled to provide a first fuel gas compressed fraction which is collected, in which step (Ie) there is tapped off from the first compressed fraction a second compressed fraction which is then cooled, then mixed with the expanded liquefied natural gas stream.

Refrigeration methods of this type are well known to those skilled in the art and have been in use for many years.

The method for refrigerating liquefied natural gas (LNG) according to the above preamble is used in the known way with a view to eliminating the nitrogen present sometimes in large quantities in the natural gas. In this case, the fuel gas obtained using this method is nitrogen-rich, whereas the refrigerated liquefied natural gas is nitrogen-depleted.

Installations for liquefying natural gas have well-defined technical characteristics and limits dictated by the capacity of the production elements of which they are made. In consequence, an installation producing liquefied natural gas is limited by its maximum production capacity, under normal operating conditions. The only way to increase production consists in building a new production unit.

Given the cost that such an investment represents, it is necessary to make sure that the desired increase in production will be lasting, so as to make the cost easier to amortize.

At the present time there is no way to increase production of a liquefied natural gas production unit, even temporarily, when this unit is running at full capacity, without resorting to heavy and expensive investment consisting in building another production unit.

The liquefied natural gas (LNG) production capacity depends essentially on the power of the compressors used to refrigerate and liquefy the natural gas.

This being the case, a first object of the invention is to propose a method, in other respects in accordance with the generic definition given in the above preamble, that allows the capacity of an LNG production unit to be increased without having to resort to building another LNG production unit, and which is essentially characterized in that the method comprises a second step (II) in which step (IIa) the second compressed fraction is compressed in a second compressor coupled to an expansion turbine to provide a third compressed fraction, in which step (IIb) the third compressed fraction is cooled, then split into a fourth compressed fraction and a fifth compressed fraction, in which step (IIc) the fourth compressed fraction is cooled and expanded in the expansion turbine coupled to the second compressor to provide an expanded fraction which is then heated, then introduced into a medium-pressure first stage of the compressor, and in which step (IId) the fifth compressed fraction is cooled, then mixed with the expanded liquefied natural gas stream.

A first merit of the invention is that it has discovered that a production unit running at 100% capacity, producing a certain delivery of liquefied natural gas at a temperature of −160° C. and at a pressure close to 50 bar, all other operating parameters being constant, can have its delivery, and therefore its production, increased only by increasing the temperature at which the liquefied natural gas is produced.

However, the LNG is stored at about −160° C. at low pressure (under 1.1 bar absolute), and an increase in its storage temperature would lead to an increase in its storage pressure, and this represents prohibitive costs, and above all difficulties with transport, because of the very large quantities of LNG produced.

In consequence, it is common practice for the LNG to be prepared at a temperature close to −160° C. prior to its being stored.

A second merit of the invention is that it presents an elegant solution to these limits on production by using a method for refrigerating LNG that can be adapted to an already-existing method for producing LNG, not requiring the use of significant financial and concrete means to implement this method. This solution comprises the production, by an already-existing LNG production unit, of LNG at a temperature above about −160° C., then refrigerating it to about −160° C. using the method according to the invention.

A third merit of the invention is that it has modified a known method in accordance with the preamble above for refrigerating nitrogen-rich liquefied natural gas and that it has allowed it to be used both with nitrogen-rich LNG and with nitrogen-depleted LNG. In the latter instance, the fuel gas obtained using this method contains very little nitrogen, and therefore has a composition close to that of the nitrogen-depleted liquefied natural gas.

According to a first aspect of the method of the invention, the expanded liquefied natural gas stream can be split, prior to step (Ib), into a second top fraction and a second bottom fraction, the second top fraction can be heated, then introduced into the first compressor in an intermediate medium-pressure second stage between the medium-pressure first stage and a low-pressure stage, and the second bottom fraction can be split into the first top fraction and the first bottom fraction.

According to the first aspect of the method of the invention, each compression step can be followed by a cooling step.

According to a second of its aspects, the invention relates to a refrigerated liquefied natural gas and a fuel gas obtained by any one of the above-defined methods.

According to a third of its aspects, the invention relates to an installation for refrigerating a pressurized liquefied natural gas containing methane and $C_2$ and higher hydrocarbons, comprising means for carrying out a first step (I) in which step (Ia) said pressurized liquefied natural gas (1) is expanded to provide an expanded liquefied natural gas stream, in which step (Ib) said expanded liquefied natural gas is split into a relatively more volatile first top fraction and a relatively less volatile first bottom fraction, in which step (Ic) the first bottom fraction consisting of refrigerated liquefied natural gas is collected, in which step (Id) the first top fraction is heated, compressed in a first compressor and cooled to provide a first fuel gas compressed fraction which is collected, in which step (Ie) there is tapped off from the first compressed fraction a second compressed fraction which is then cooled, then mixed with the expanded liquefied natural gas stream, characterized in that the installation comprises means for carrying out a second step (II) in which step (IIa) the second compressed fraction is compressed in a second compressor coupled to an expansion turbine to provide a third compressed fraction, in which step (IIb) the third compressed fraction is cooled, then split into a fourth compressed fraction and a fifth compressed fraction, in which step (IIc) the fourth compressed fraction is cooled and expanded in the expansion turbine coupled to the second compressor to provide an expanded fraction which is then heated, then introduced into a medium-pressure first stage of the compressor, and in which step (IId) the fifth compressed fraction is cooled, then mixed with the expanded liquefied natural gas stream.

According to a first alternative form according to its third aspect, the invention relates to an installation comprising means for splitting the expanded liquefied natural gas stream, prior to step (Ib), into a second top fraction and a second bottom fraction, in that the installation comprises means for heating, then introducing the second top fraction into the first compressor in an intermediate medium-pressure second stage between the medium-pressure first stage and a low-pressure stage, and in that it comprises means for splitting the second bottom fraction into the first top fraction and the first bottom fraction.

According to a first embodiment according to its third aspect, the invention relates to an installation in which the first top fraction and the first bottom fraction are separated in a first separating vessel.

According to a second embodiment according to its third aspect, the invention relates to an installation in which the first top fraction and the first bottom fraction are separated in a distillation column.

According to one embodiment according to the first alternative form of its third aspect, the invention relates to an installation in which the expanded liquefied natural gas stream can be split into the second top fraction and the second bottom fraction in a second separating vessel.

According to its second embodiment according to its third aspect, the invention relates to an installation in which the distillation column comprises at least one lateral and/or column-bottom reboiler, in that liquid tapped off a plate of the distillation column passing through said reboiler is heated in a second heat exchanger, then reintroduced into the distillation column at a stage below said plate, and in that the expanded liquefied natural gas stream is cooled in said second heat exchanger.

According to a third embodiment according to its third aspect, the invention relates to an installation in which the cooling of the first top fraction and of the expanded fraction, and the heating of the fourth compressed fraction and of the fifth compressed fraction take place in one and the same first heat exchanger.

According to the first alternative form according to its third aspect, the invention relates to an installation in which the second top fraction is heated in the first heat exchanger.

The invention will be better understood and other objects, features, details and advantages thereof will become more clearly apparent in the course of the description which follows with reference to the attached schematic drawings given solely by way of nonlimiting example and in which.

In these seven figures, there are the symbols "FC", which stands for "flow controller", "GT" which stands for "gas turbine", "GE" which stands for "electric generator", "LC" which stands for "liquid level controller", "PC" which stands for "pressure controller", "SC" which stands for "speed controller" and "TC" which stands for "temperature controller".

For clarity and succinctness, the pipes used in the installations of FIGS. 1 to 7 will be identified by the same reference symbols as the gaseous fractions passing through them.

Figure 1:
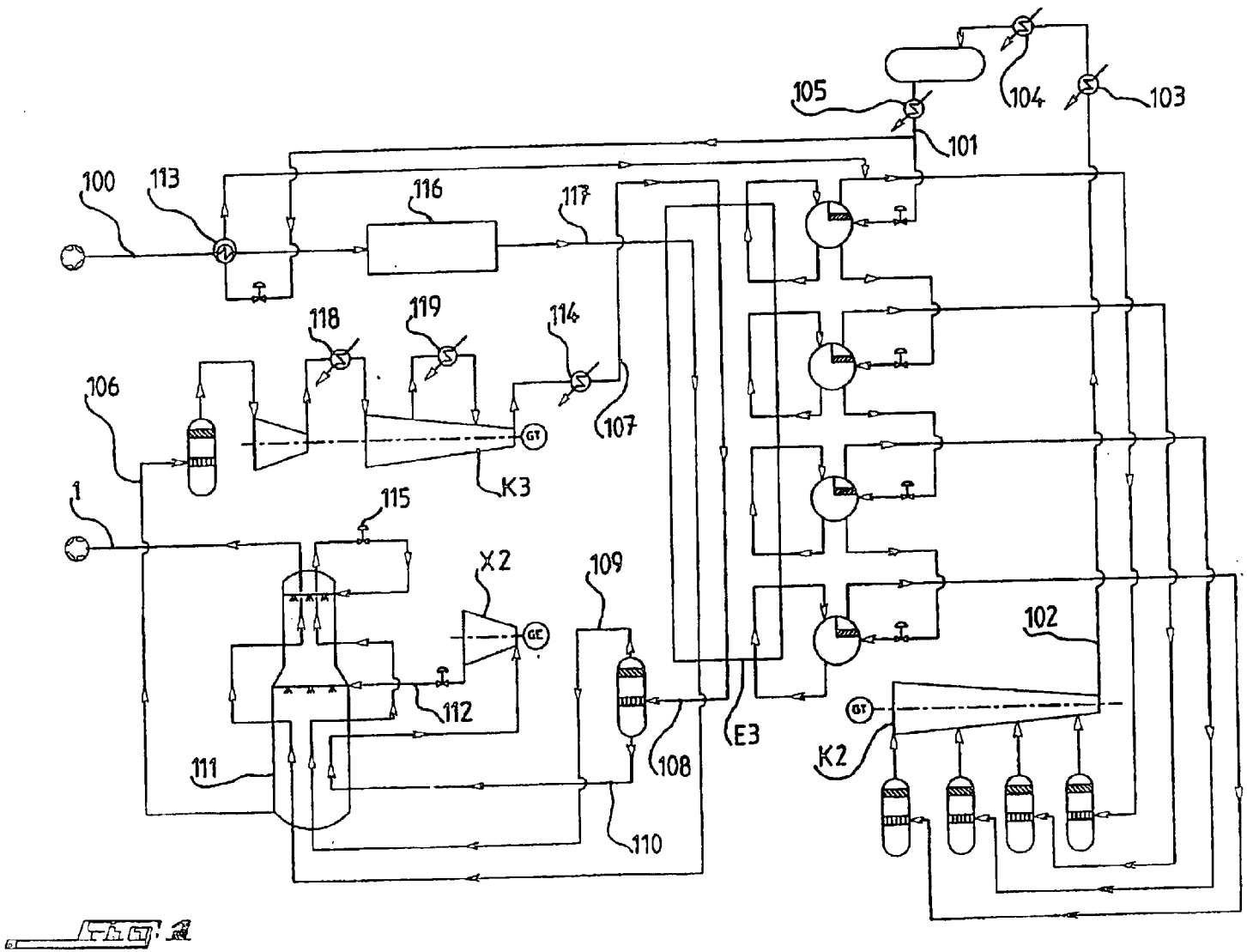
FIG. 1 depicts a functional block diagram of an installation for liquefying natural gas according to one embodiment of the prior art.

Referring to FIG. 1, the installation depicted is intended, in a known way, to treat a dried, desulfurized and decarbonated natural gas 100, to obtain liquefied natural gas 1, generally available at a temperature below −120° C.

This installation for liquefying LNG has two independent cooling circuits. A first cooling circuit 101, corresponding a propane cycle, makes it possible to obtain primary cooling to about −30° C. in an exchanger E3 by expanding and vaporizing liquid propane. The heated and expanded propane vapor is then compressed in a second compressor K2, then the compressed gas 102 obtained is then cooled and liquefied in water coolers 103, 104 and 105.

A second cooling circuit 106, corresponding in general to a cycle operating on a mixture of nitrogen, methane, ethane and propane, allows significant cooling of the natural gas that is to be treated, to obtain liquefied natural gas 1. The heat transfer fluid present in the second cooling cycle is compressed in a third compressor K3 and cooled in water exchangers 118 and 119 and is then cooled in a water cooler 114 to obtain a fluid 107. The latter is then cooled and liquefied in the exchanger E3 to provide a cooled and liquefied stream 108. The latter is then split into a vapor phase 109 and a liquid phase 110 which are both introduced into the lower part of a cryogenic exchanger 111. After cooling, the liquid phase 110 then leaves the exchanger 111 to be expanded in a turbine X2 coupled to an electric generator. The expanded fluid 112 is then introduced into the cryogenic exchanger 111 above its lower part, where it is used to cool the fluids passing through the lower part of the exchanger, by being sprayed onto the pipes conveying the fluids that are to be cooled, using spray booms. The vapor phase 109 passes through the lower part of the cryogenic exchanger 111 where it is cooled and liquefied, and is then cooled further by passing through an upper part of the cryogenic exchanger 111. Finally, this cooled and liquefied fraction 109 is expanded in a valve 115, then used to cool the fluids passing through the upper part of the cryogenic exchanger 111, by spraying it onto the pipes conveying the fluids that are to be cooled. The liquid coolants sprayed inside the cryogenic exchanger 111 are then collected at the bottom of the exchanger to provide the stream 106 which is sent to the compressor K3.

The dried, desulfurized and decarbonated natural gas 100 is cooled in a propane heat exchanger 113 and then subjected to a drying treatment, which may, for example, involve passing it over a molecular sieve, for example made of zeolite, and to a demercurization treatment, for example by passing it over a silver foam or over any other mercury trap, in a chamber 116 to provide a purified natural gas 117. The latter is then cooled and partially liquefied in the heat exchanger E3, passes through the lower part, then through the upper part of the cryogenic exchanger 111 to provide a liquefied natural gas 1. The latter is customarily obtained at a temperature below −120° C.

Figure 2:
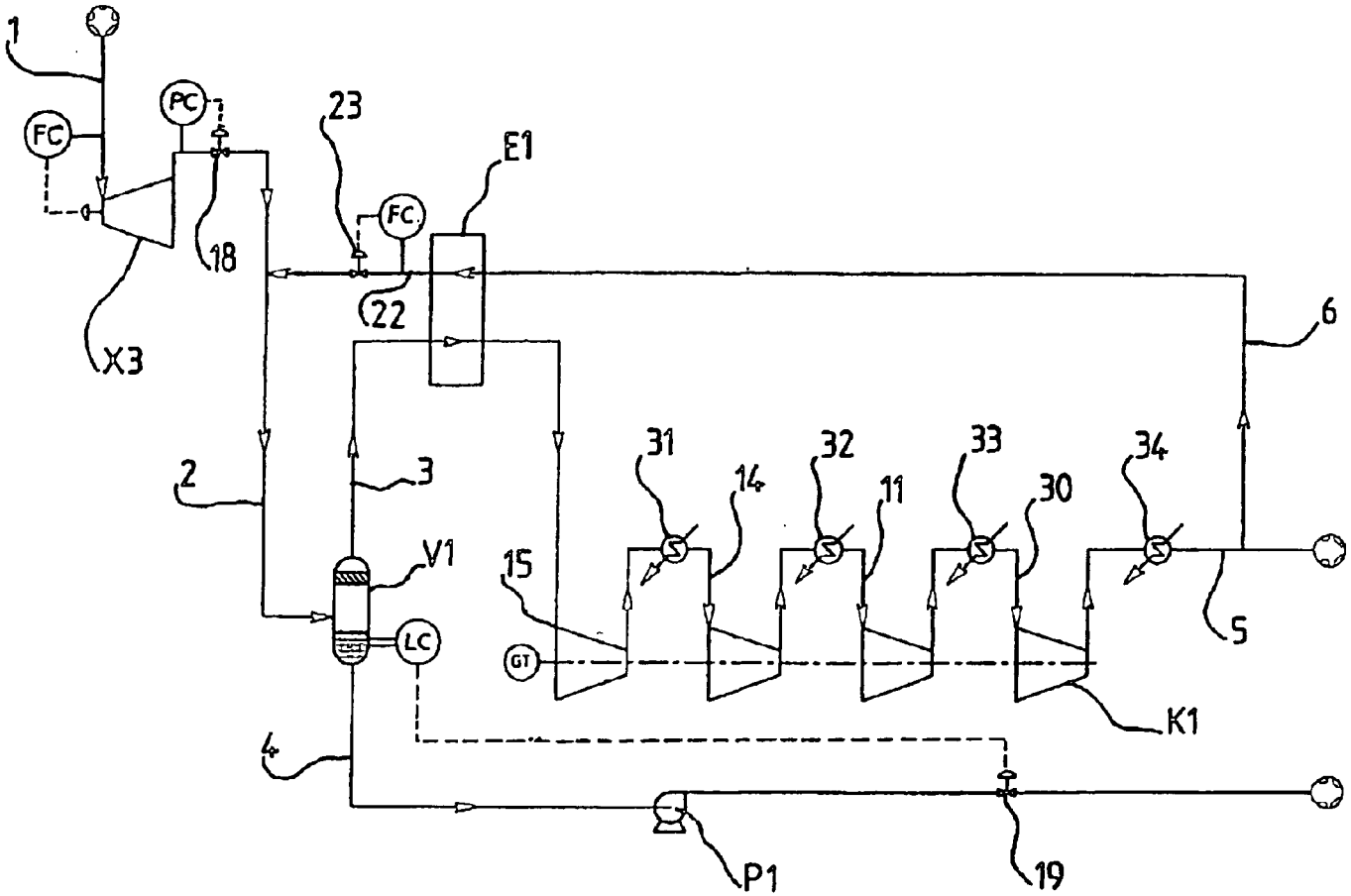
FIG. 2 depicts a functional block diagram of an installation for removing nitrogen from liquefied natural gas according to a first embodiment of the prior art.

Referring now to FIG. 2, the installation depicted is intended, in the known way, to treat a nitrogen-rich liquefied natural gas 1 to obtain, on the one hand, a nitrogen-depleted cooled liquefied natural gas 4 and, on the other hand, a first compressed fraction 5 which is a nitrogen-rich compressed fuel gas.

The LNG 1 is first of all expanded and cooled in an expansion turbine X3 which is regulated by a flow controller controlling the flow of LNG passing through the pipe 1, then is expanded and cooled again in a valve 18 the opening of which is dependent on the pressure of the LNG leaving the compressor X3, to provide an expanded liquefied natural gas stream 2. The latter is then split into a relatively more volatile first top fraction 3 and a relatively less volatile bottom fraction 4 in a vessel V1. The first bottom fraction 4 consisting of cooled liquefied natural gas is collected and pumped in a pump P1, passes through a valve 19, the opening of which is regulated by a level controller controlling the level of liquid in the bottom of the vessel V1, to then leave the installation and go for storage.

The first top fraction 3 is heated in a first heat exchanger E1 and is then introduced into a low-pressure stage 15 of a compressor K1 coupled to a gas turbine GT. This compressor K1 comprises a plurality of compression stages 15, 14, 11 and 30, at progressively higher pressures, and a plurality of water coolers 31, 32, 33 and 34. After each compression stage, the compressed gases are cooled by passing them through a heat exchanger, preferably a water heat exchanger. The first top fraction 3, at the end of the compression and cooling steps, provides the nitrogen-rich compressed fuel gas 5. This fuel gas is then collected and leaves the installation.

A small part of the fuel gas 5 which corresponds to a stream 6 is tapped off. This stream 6 is cooled in the exchanger E1, giving up its heat to the first top fraction 3, to yield a cooled stream 22. This cooled stream 22 then flows through a valve 23 the opening of which is controlled by a flow controller at the outlet of the exchanger E2. The stream 22 is finally mixed with the expanded liquefied natural gas stream 2.

Figure 3:
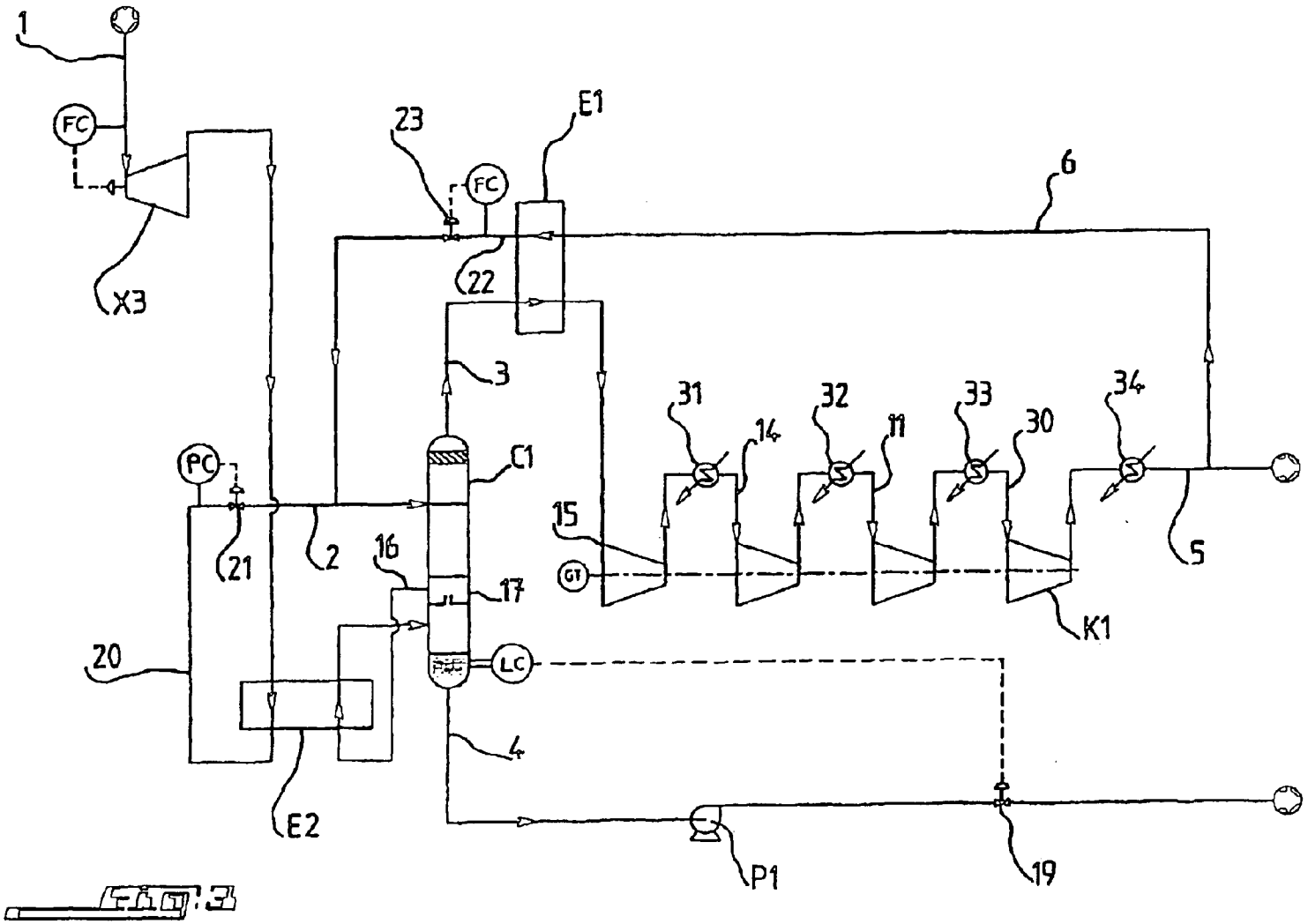
FIG. 3 depicts a functional block diagram of an installation for removing nitrogen from liquefied natural gas according to a second embodiment of the prior art.

Referring now to FIG. 3, the installation depicted is intended, in the known way, to treat a nitrogen-rich liquefied natural gas 1 to obtain, on the one hand, a cooled and nitrogen-depleted liquefied natural gas 4 and, on the other hand, a first compressed fraction 5 which is a nitrogen-rich compressed fuel gas. In this installation, the separating vessel V1 has been replaced by a distillation column C1 and a heat exchanger E2.

The LNG 1 is first of all expanded and cooled in an expansion turbine X3 the speed of which is controlled by a flow controller controlling the flow of LNG through the pipe 1, and is then cooled in the heat exchanger E2 to provide a cooled stream 20. The latter passes through a valve 21, the opening of which is controlled by a pressure controller on the pipe 20, upstream of said valve 21, to provide an expanded liquefied natural gas stream 2. The expanded liquefied natural gas stream 2 is then split into a relatively more volatile first top fraction 3 and a relatively less volatile first bottom fraction 4 in the column C1. The first bottom fraction 4 consisting of cooled liquefied natural gas is collected and pumped in a pump P1, passes through a valve 19 the opening of which is controlled by a level controller controlling the level of liquid in the bottom of the vessel V1, and then leaves the installation and goes for storage.

The column C1 comprises a column bottom reboiler 16 which uses liquid contained on a plate 17. The stream passing through the reboiler 16 is heated in the heat exchanger E2 and then introduced into the bottom of the column C1.

The first top fraction 3 follows the same treatment as set out in FIG. 2, to obtain a first compressed gas fraction 5, which is a nitrogen-rich compressed fuel gas, and a second compressed fraction 6 which is a tapped-off compressed fuel gas fraction. Similarly, the latter fraction is heated in the exchanger E1 to yield a cooled stream 22. This stream 22 is also mixed with the expanded liquefied natural gas stream 2.

Figure 4:
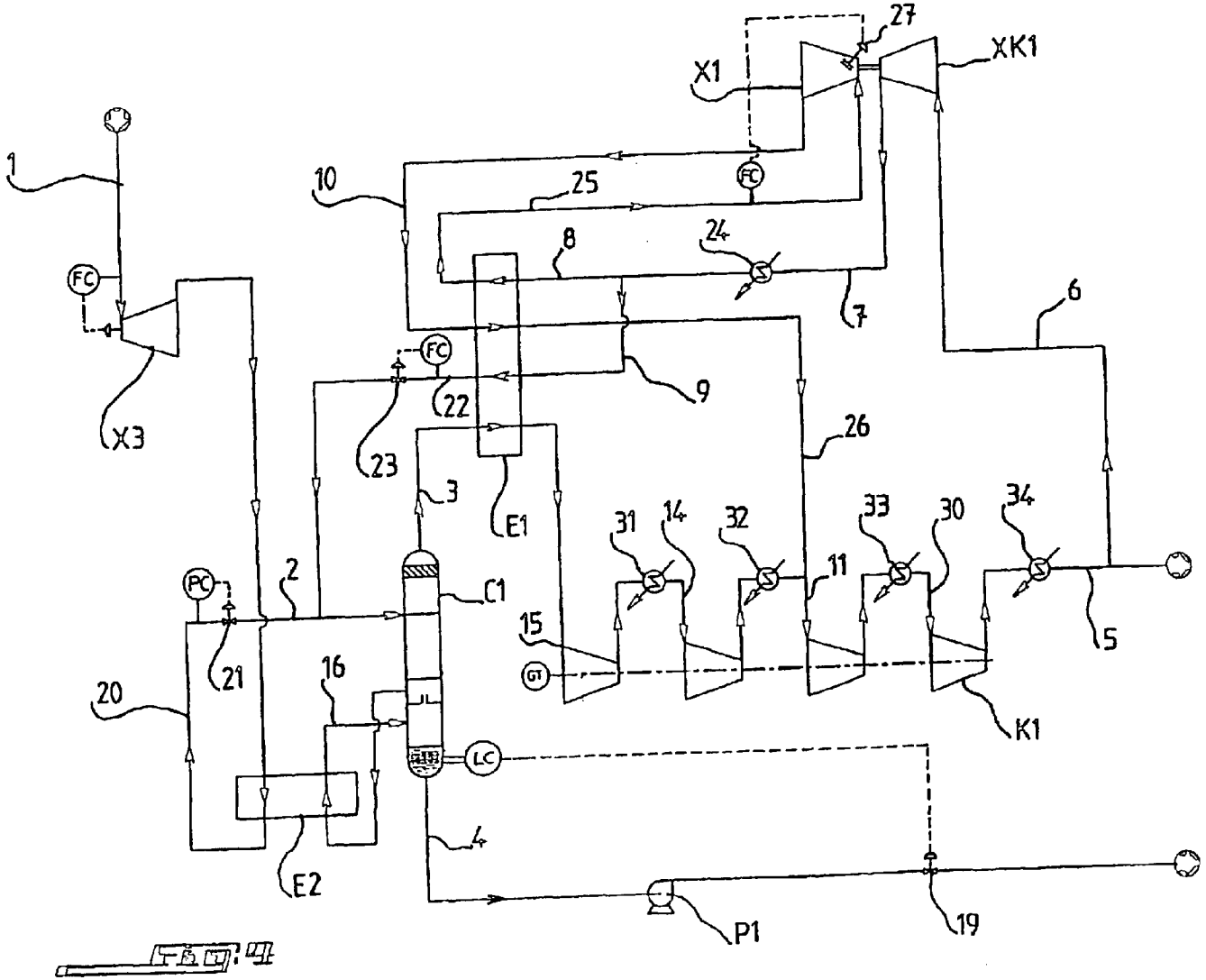
FIGS. 4, 5, 6 and 7 depict functional block diagrams of installations possibly for removing nitrogen from liquefied natural gas according to some preferred embodiments of the invention.

Referring now to FIG. 4, the installation depicted is intended, with the aid of a device according to the method of the invention, to treat a nitrogen-rich liquefied natural gas 1 to obtain, on the one hand, a nitrogen-depleted and cooled liquefied natural gas 4 and, on the other hand, a nitrogen-rich compressed fuel gas 5.

This installation comprises elements in common with FIG. 3, particularly the expansion and cooling of the LNG 1 to obtain the expanded LNG stream 2. Likewise, the splitting into the first top fraction 3 and the first bottom fraction 4 is performed in a similar way in the column C1. Finally, the fuel gas stream 5 is obtained, as before, by successive compression and cooling operations. Unlike the method set out in FIG. 3, a second compressed fraction 6, tapped off the first compressed gas fraction 5 is fed to a compressor XK1 coupled to an expansion turbine X1 to obtain a third compressed fraction 7. This fraction is cooled in a water cooler 24, then split into a fourth compressed fraction 8 and a fifth compressed fraction 9.

The fourth compressed fraction 8 is cooled in the heat exchanger E1 to provide a fraction 25 which is expanded in the turbine X1. The turbine X1 supplies an expanded stream 10 which is heated in the exchanger E1 to give a heated expanded stream 26. This heated expanded stream 26 is introduced into a medium-pressure stage 11 of the compressor K1.

The fifth compressed fraction 9 is cooled in the heat exchanger E1 to provide a fraction 22 which is expanded in a valve 23 then mixed with the expanded LNG fraction 2.

The expander X1 comprises an inlet guide valve 27 making it possible, by varying the angle at which the stream 25 is introduced to the blades of the turbine X1, to vary the speed at which the latter rotates, and therefore to cause the power delivered to the compressor XK1 to vary.

Figure 5:
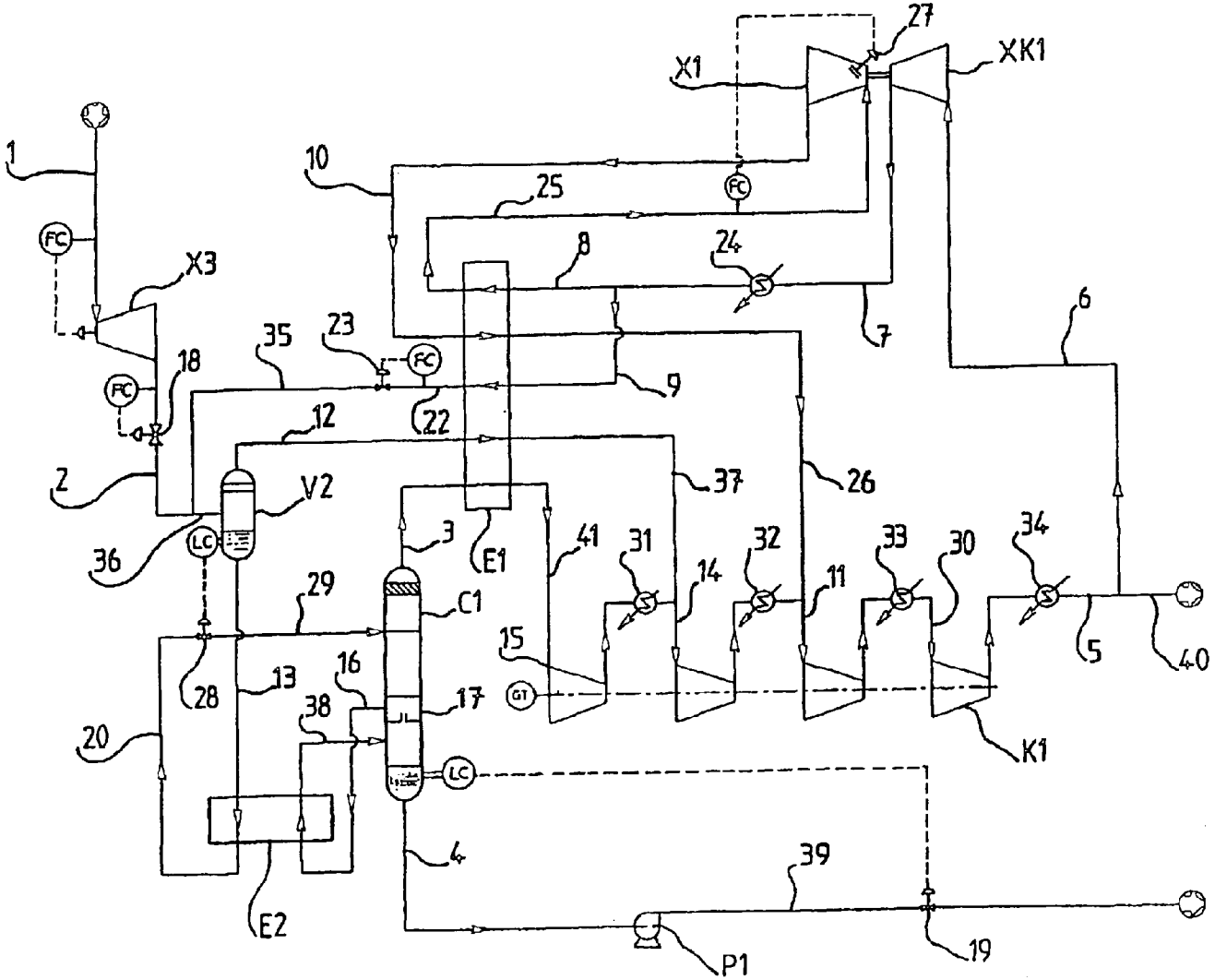

Referring now to FIG. 5, the installation depicted is intended, with the aid of a device according to the method of the invention, to treat a liquefied natural gas 1, preferably nitrogen rich, to obtain, on the one hand, a cooled and nitrogen-depleted liquefied natural gas 4 and, on the other hand, a nitrogen-rich compressed fuel gas 5, when the liquefied natural gas 1 contains nitrogen.

This installation comprises elements in common with FIG. 4, particularly the production, by a distillation column C1, of a first top fraction 3 and of a first bottom fraction 4. Similarly, the first top fraction 3 is compressed in a compressor K1 and cooled in coolers 31–34 to obtain a first compressed fraction 5. A second tapped-off fraction 6 is tapped off the first compressed fraction 5 to be compressed in a compressor XK1 coupled to an expansion turbine X1, which at outlet produces a third compressed fraction 7. The latter is split into a fourth compressed fraction 8 and a fifth compressed fraction 9.

The fourth compressed fraction 8 is cooled in the heat exchanger E1 to provide a fraction 25 which is expanded in the turbine X1. The turbine X1 supplies an expanded stream 10 which is heated in the exchanger E1 to give a heated expanded stream 26. This heated expanded stream 26 is introduced into a medium-pressure stage 11 of the compressor K1.

The fifth compressed fraction 9 is cooled in the heat exchanger E1 to provide a fraction 22 which is expanded in a valve 23, then mixed with the expanded LNG fraction 2.

The expander X1 comprises an inlet guide valve 27 whose purpose was defined in the description of FIG. 4.

Unlike FIG. 4, the installation depicted in FIG. 5 further comprises a separating vessel V2 in which the expanded natural gas stream 2 is split into a second top fraction 12 and a second bottom fraction 13.

The second top fraction 12 is heated in the exchanger E1 then introduced into a medium-pressure stage 14 of the compressor K1, at a pressure that it is intermediate between the inlet pressure of the low pressure stage 15 and that of the medium-pressure stage 11.

The second bottom fraction 13 is cooled in an exchanger E2 to produce a cooled LNG fraction 20. This last fraction is expanded and cooled in a valve 28 to produce an expanded and cooled LNG fraction 29. The opening of the valve 28 is controlled by a level controller controlling the level of liquid contained in the vessel V2. The stream 29 is then introduced into the column C1 where it is split into the first top fraction 3 and the first bottom fraction 4.

As indicated during the description of FIG. 4, the column C1 comprises a reboiler 16 which taps off liquid contained on a plate 17 of the column C1 to heat it in the exchanger E2 by heat exchange with the stream 13, and introduce it into the bottom of the column. Likewise, the first bottom fraction 4 is pumped by a pump P1 and passes through a valve 19 the opening of which is controlled by a level controller controlling the level of liquid present in the bottom of the column C1.

Figure 6:
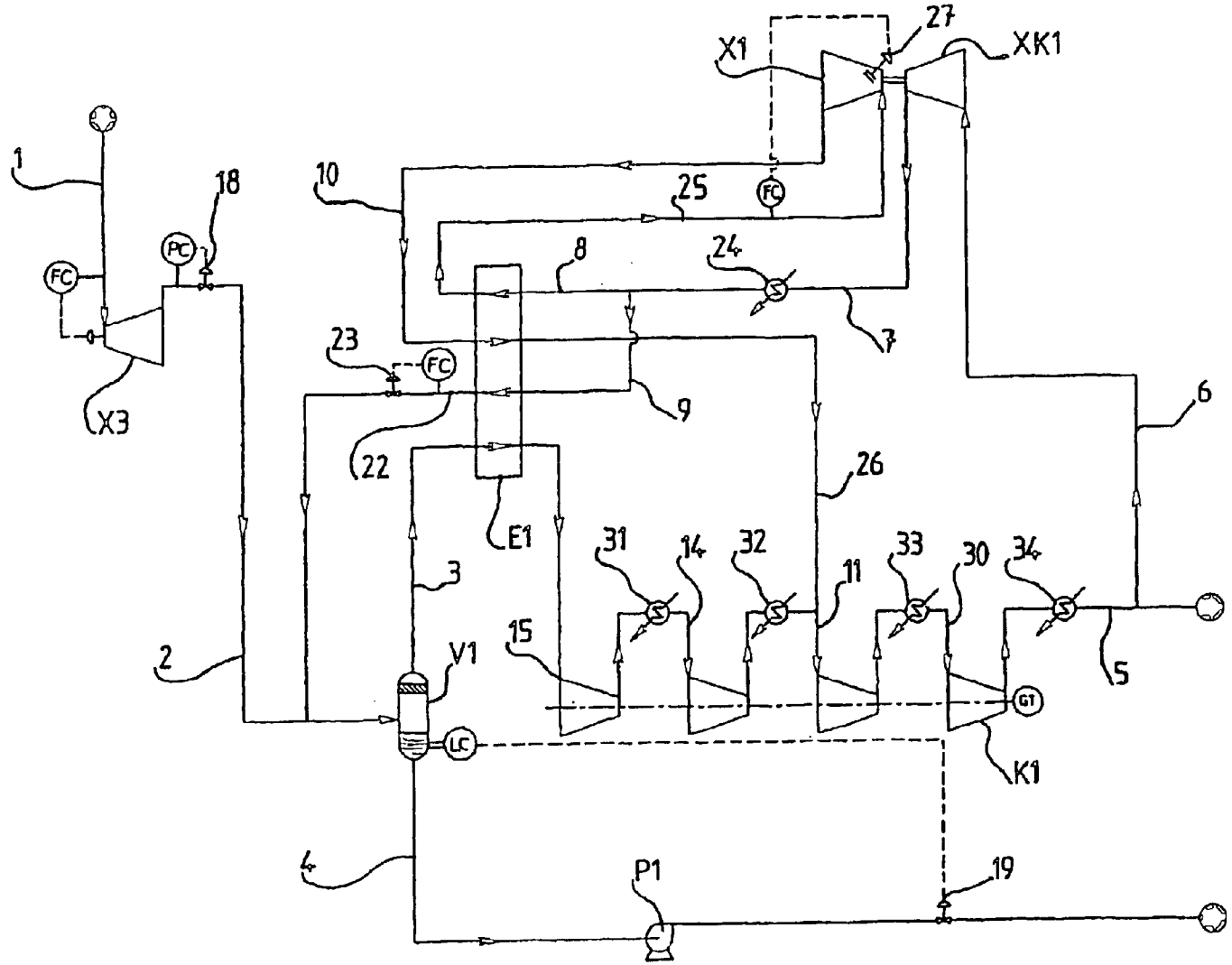

Referring now to FIG. 6, the installation depicted is intended, with the aid of a device according to the method of the invention, to treat a liquefied natural gas 1, preferably nitrogen-depleted, to obtain, on the one hand, a cooled and nitrogen-depleted liquefied natural gas 4 and, on the other hand, a nitrogen-rich compressed fuel gas 5, when an LNG 1 rich in nitrogen is used.

This installation comprises elements common to FIG. 2 and FIGS. 4 and 5.

In a simplified way, FIG. 6 is structurally similar to FIG. 4 except that the column C1 has been replaced by a separating vessel V1, and the exchanger E2 has been omitted, because there is no reboiler when using a separating vessel. The expanded LNG stream 2 is therefore introduced directly into the separating vessel V1 to be split into a first top fraction 3 and a first bottom fraction 4.

Replacing the column C1 with the vessel V1 does not alter the sequence of steps of the method as described for FIG. 5. By contrast, because the vessel V1 does not have such good separation performance as the column C1, the cooled LNG 4 will normally contain more nitrogen when a device according to FIG. 6 is used than when a device according to FIG. 5 is used. Of course, the LNG 1 used in both instances is physically and chemically identical, and contains at least a little nitrogen.

Figure 7:
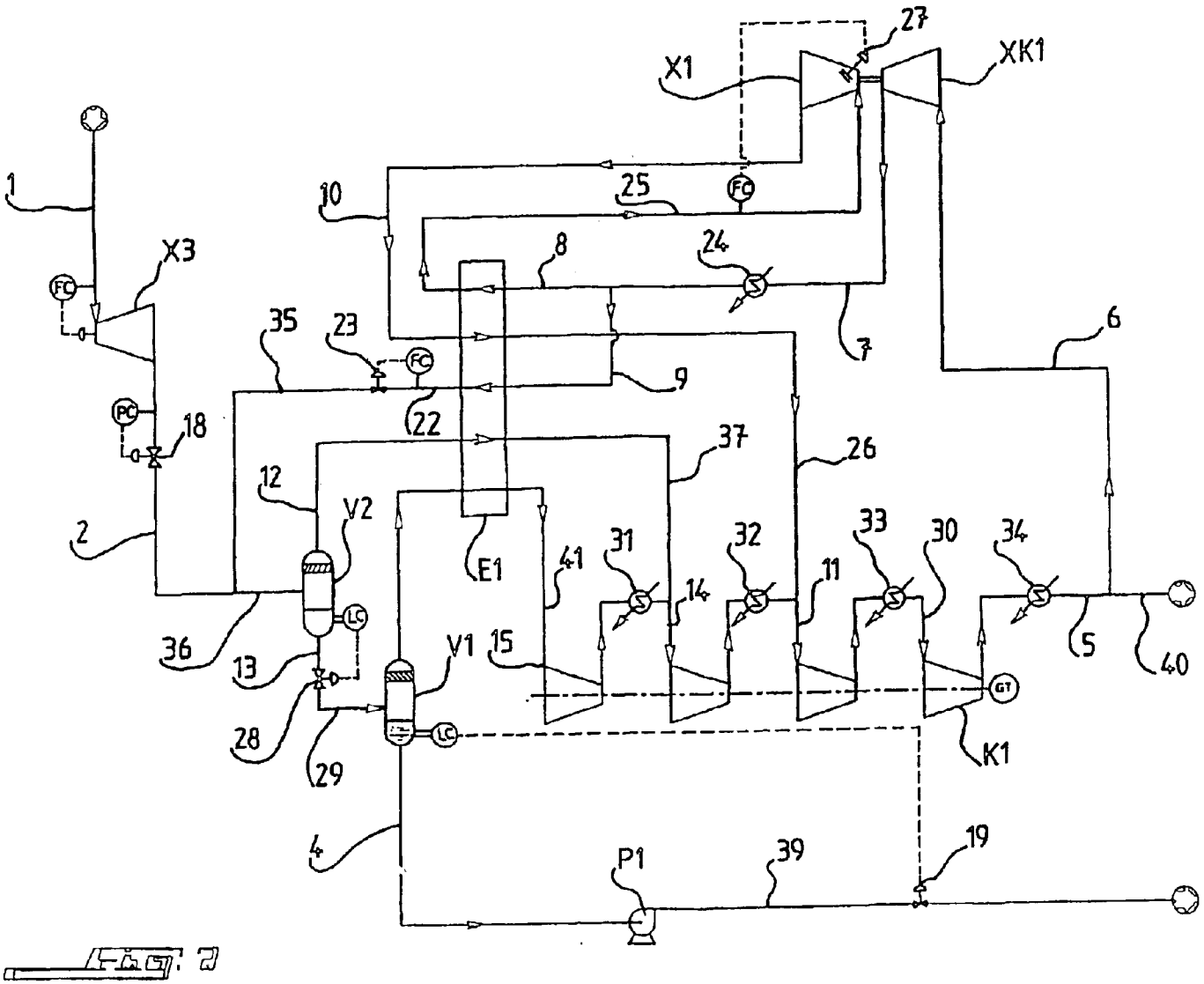

Referring to FIG. 7, the installation depicted is intended, with the aid of a device according to the method of the invention, to treat a liquefied natural gas 1, preferably nitrogen-depleted, to obtain, on the one hand, a cooled liquefied natural gas 4 and, on the other hand, a compressed fuel gas 5.

This installation comprises elements common to FIG. 2 and to FIGS. 4, 5 and 6.

In a simplified way, FIG. 7 is structurally similar to FIG. 5 except that the column C1 has been replaced by a separating vessel V1, and the exchanger E2 has been omitted, because there is no reboiler when using a separating vessel. The expanded LNG stream 2 is therefore introduced directly into the separating vessel V2 to be split into a second top fraction 12 and a second bottom fraction 13.

The second top fraction 12 is heated in an exchanger E1 then introduced into a compressor K1 at an intermediate medium-pressure stage 14, between a low-pressure stage 15 and a medium-pressure stage 11, in the same way as described for FIG. 5.

Replacing the column C1 with the vessel V1 does not alter the sequence of steps of the method as described for FIG. 5. By contrast, because the vessel V1 does not have such good separating performance as the column C1, the cooled LNG 4 will normally contain more nitrogen when a device according to FIG. 6 is used than when a device according to FIG. 5 is used. Of course, in order to allow for a valid comparison, the LNG 1 used in both cases is physically and chemically identical.

In order to allow a material assessment of the performance of an installation operating according to a method according to the invention, numerical examples are now given, for illustrative rather than limitative purposes.

These examples are given on the basis of two different natural gases "A" and "B", the composition of which is given below in table 1:

TABLE 1

| | Natural gas A | | Natural Gas B | |
|---|---|---|---|---|
| Component | Molar composition (%) | Composition by mass (%) | Molar composition (%) | Composition by mass (%) |
| Nitrogen | 0.100 | 0.155 | 3.960 | 6.127 |
| Methane | 91.400 | 81.378 | 88.075 | 78.039 |
| Ethane | 4.500 | 7.510 | 5.360 | 8.902 |
| Propane | 2.500 | 6.118 | 1.845 | 4.493 |
| i-Butane | 0.600 | 1.935 | 0.290 | 0.931 |
| n-Butane | 0.900 | 2.903 | 0.470 | 1.509 |
| Total | 100.000 | 100.000 | 100.000 | 100.000 |

These gases are deliberately free of C5 and higher hydrocarbons, so as not to make the calculations any more complicated.

The other operating conditions are identical and as follows (the reference numerals relate to FIG. 1):

temperature of the wet natural gas 100: 37° C.

pressure of the wet natural gas 100: 54 bar pre-cooling by the cooler 113 prior to drying: 23° C.

temperature of the dry gas after it has passed through chamber 116: 23.5° C.

pressure of the dry gas: 51 bar temperature of the cooling water: 30° C.

temperature at the exit of the water exchanger: 37° C.

temperature at which propane condenses: 47° C.

efficiency of the centrifugal compressors K1, K2 and K3: 82% efficiency of the expansion turbine X2: 85% efficiency of the axial compressor XK1: 86% power on a GE6 shaft run: 31570 kW power on a GE7 shaft run: 63140 kW power on a GE5 D shaft run: 24000 kW The power on a shaft run represents the power available on a shaft of a general electric gas turbine reference GE5D, GE6 and GE7. Turbines of this type are coupled to the compressors K1, K2 and K3 depicted in FIGS. 1–7.

The deliveries of natural gas to be liquefied will be chosen to saturate the available power on the shaft runs. The following three cases are envisioned (for a liquefication method described in FIG. 1):

Use for driving one GE6 turbine and one GE7 turbine, which corresponds to a delivery of LNG produced at −160° C. of about 3 million tonnes per year.

Use for driving two GE7 turbines, which corresponds to a delivery of LNG produced at −160° C. of about 4 million tonnes per year.

Use for driving three GE7 turbines, which corresponds to a delivery of LNG produced at −160° C. of about 6 million tonnes per year.

One of the ways for easily calculating the influence of a parameter without going into the details of a method is that of the idea of Theoretical Work associated with the idea of Exergy.

The theoretical work that has to be given to a system in order to cause it to change from state 1 to state 2 is given by the following equation:

$$W1\text{-}2=T0\times(S1-S2)-(H1-H2)$$

With:

W1-2: theoretical work (kJ/kg)
T0: temperature at which heat is rejected (K)
S1: entropy in state 1 (kJ/(K.kg))
S2: entropy in state 2 (kJ/(K.kg))
H1: enthalpy in state 1 (kJ/kg)
H2: enthalpy in state 2 (kJ/kg)

In this instance, the rejection temperature will be taken as being equal to 310.15 K (37° C.). State 1 will be the natural gas at 37° C. and 51 bar and state 2 will be the LNG at a temperature T2 and at 50 bar.

Table 2 below shows the change in theoretical work to liquefy natural gases A and B according to the temperature of the LNG leaving the liquefication method. When the power of the refrigeration compressors is constant, the reduction in theoretical work results in a possible increase in the capacity of the liquefication cycle.

TABLE 2

| | Natural Gas A | | |
|---|---|---|---|
| Temperature of the LNG 1 (° C.) | Theoretical work (kJ/kg) | Theoretical work (%) | Possible capacity (%) |
| −130 | 356.63 | 71.19 | 140.46 |
| −135 | 376.93 | 75.25 | 132.90 |
| −140 | 398.45 | 79.54 | 125.72 |
| −145 | 421.57 | 84.16 | 118.82 |
| −150 | 446.24 | 89.08 | 112.26 |
| −155 | 472.64 | 94.35 | 105.99 |
| −160 | 500.93 | 100.00 | 100.00 |
| ********** | Natural Gas B | | |
| −130 | 355.89 | 71.35 | 140.16 |
| −135 | 376.04 | 75.39 | 132.65 |
| −140 | 397.43 | 79.67 | 125.51 |
| −145 | 420.23 | 84.24 | 118.70 |

TABLE 2-continued

| | Natural Gas A | | |
|---|---|---|---|
| Temperature of the LNG 1 (° C.) | Theoretical work (kJ/kg) | Theoretical work (%) | Possible capacity (%) |
| −150 | 444.56 | 89.12 | 112.21 |
| −155 | 470.74 | 94.37 | 105.97 |
| −160 | 498.82 | 100.00 | 100.00 |

It can be seen that the figures obtained with the gases A and B are very similar. The possible increase in capacity is about 1.14% per 0° C. of temperature of the LNG 1 obtained at the exit of the liquefication unit set out in FIG. 1.

The capacity C1 for a temperature T1 of the LNG produced can be expressed as a function of the capacity C0 at the temperature T0, using the following equation:

$$C1=C0\times1.0114^{(T1-T0)}$$

With:

C1: capacity to produce LNG at T1 (kg/h)
C0: capacity to produce reference LNG at T0 (kg/h)
T1: LNG production temperature (° C.)
T2: reference LNG production temperature (° C.)

As a result, at −140° C., the capacity of the LNG production unit is 125.5% of its capacity at −160° C., which is a considerable difference.

The actual work of an LNG production unit will obviously be dependent upon the method chosen. The method depicted in FIG. 1, which is known by the name of MCR®, is a well known method widely used and developed by the company APCI.

This method is used here in a special way that gives it very good performance: the propane cycle has 4 stages and the MCR (multiple component refrigerant, stream 106, FIG. 1) refrigeration and propane refrigeration (stream 102, FIG. 1) takes place in the heat exchanger E3, which is a brazed aluminum plate-type exchanger.

The results obtained are set out table 3:

TABLE 3

| | Natural Gas A | | |
|---|---|---|---|
| Temperature of the LNG 1 (° C.) | Actual work (kJ/kg) | Actual work (%) | Possible capacity (%) |
| −130 | 702.77 | 72.23 | 138.45 |
| −135 | 739.93 | 76.05 | 131.50 |
| −140 | 781.25 | 80.29 | 124.54 |
| −145 | 820.56 | 84.33 | 118.58 |
| −150 | 867.88 | 89.20 | 112.11 |
| −155 | 917.44 | 94.29 | 106.05 |
| −160 | 972.99 | 100.00 | 100.00 |
| ********** | Natural Gas B | | |
| −130 | 688.86 | 71.24 | 140.37 |
| −135 | 728.22 | 75.31 | 132.78 |
| −140 | 772.16 | 79.86 | 125.23 |
| −145 | 814.34 | 84.22 | 118.74 |
| −150 | 861.75 | 89.12 | 112.21 |
| −155 | | 94.37 | 105.97 |
| −160 | | 100.00 | 100.00 |

It can be seen that these results perfectly corroborate those obtained using the theoretical work calculations and set out in table 1.

The efficiency of the liquefication method can be calculated from the actual work and from the theoretical work. The latter is roughly constant and is round about 51.5%, as can be seen from the results given in table 4:

TABLE 4

| Temperature of the LNG 1 (° C.) | Natural Gas A: Theoretical work (kJ/kg) | Actual work (%) | Efficiency (%) |
|---|---|---|---|
| −130 | 356.63 | 702.77 | 50.75 |
| −135 | 376.93 | 739.93 | 50.94 |
| −140 | 398.45 | 781.25 | 51.00 |
| −145 | 421.57 | 820.56 | 51.38 |
| −150 | 446.24 | 867.88 | 51.42 |
| −155 | 472.64 | 917.44 | 51.52 |
| −160 | 500.93 | 972.99 | 51.48 |
| ********** | Natural Gas B | | |
| −130 | 355.89 | 688.86 | 51.66 |
| −135 | 376.04 | 728.22 | 51.64 |
| −140 | 397.43 | 772.16 | 51.47 |
| −145 | 420.23 | 814.34 | 51.60 |
| −150 | 444.56 | 861.75 | 51.59 |

This result is particularly satisfying. The user of the method will always be assured of making best use of the liquefication method, regardless of the chosen temperature at which the LNG is produced. It can also be seen that the composition of the natural gas that is to be liquefied has no importance.

Thus, the novel use of the known liquefication method makes it possible to increase the temperature of the LNG 1 obtained at the outlet of the production unit while at the same time allowing a substantial increase in the quantity produced, which may range as high as about 40% at −130° C.

The LNG 1 obtained at the outlet of the production unit described above for FIG. 1, can have its nitrogen removed in a denitrogenation unit such as depicted in FIG. 2 or in FIG. 3. This nitrogen-removal operation is needed when the natural gas extracted from the source contains nitrogen in relatively high proportions, for example upwards of 0.100 mol % to about 5 to 10 mol %.

The installation depicted schematically in FIG. 2 is a final flash-type LNG denitrogenation unit. The flash is obtained at the time the expanded LNG 2 is split into a nitrogen-rich relatively more volatile first top fraction 3 and a nitrogen-depleted relatively less volatile first bottom fraction 4. This separation occurs in a vessel V1, as described above.

According to one mode of operation, the LNG 1 of composition "B" which contains nitrogen, produced at −150° C. and at 48 bar is expanded in the hydraulic turbine X3 to a pressure of about 4 bar then in a valve 18 to a pressure of 1.15 bar. The biphasic mixture 2 obtained is split in the separating vessel V1 into, on the one hand, the nitrogen-rich flash gas 3 and, on the other hand, the cooled LNG 4. The cooled LNG is sent for storage, as described above. The flash gas 3, which constitutes the first gaseous fraction, is heated in the exchanger E1 to −70° C. before being compressed to 29 bar in the compressor K1. The compressor K1 produces a first compressed fraction 5 which constitutes the nitrogen-rich fuel gas.

About 23% of the first compressed fraction 5 is recycled in the form of a fraction 6. The latter is cooled in the exchanger E1 by exchange of heat with the flash gas 3, and is then mixed with the expanded and cooled LNG stream 2.

This arrangement makes it possible to liquefy some of the flash gas (about 23% of it) and to reduce the amount of fuel gas produced. The performance of a denitrogenation unit according to this diagram 2 is given in table 5 below, in which the column entitled "1 GE6+1 GE7" corresponds to an LNG production unit 1 according to diagram 1, employing 1 GE6 gas turbine and 1 GE7 gas turbine for the compressors K2 and K3, "2 GE7" corresponds to the use of 2 GE7 turbines to produce LNG 1, and "3 GE7" corresponds to the use of 3 turbines:

TABLE 5

| | Units | 1 GE7 + 1 GE6 | 2 GE7 | 3 GE7 |
|---|---|---|---|---|
| LNG 1 | | | | |
| Temperature | ° C. | −150 | −150 | −150 |
| Flow rate | kg/h | 406665 | 542219 | 813330 |
| Cooled LNG 4 | | | | |
| Flow rate | kg/h | 368990 | 491985 | 737980 |
| Specific lower heat value | kJ/kg | 48412 | 48412 | 48412 |
| Nitrogen content | mol % | 1.38 | 1.38 | 1.38 |
| Production of LNG 4, lower heat value | GJ/h % | 17864<br>100 | 23818<br>100 | 35727<br>100 |
| Fuel gas 5 | | | | |
| Flow rate | kg/h | 37676 | 50235 | 75352 |
| Specific lower heat value | kJ/kg | 27492 | 27492 | 27492 |
| Production of fuel gas 5, specific lower heat value | GJ/h | 1036 | 1381 | 2072 |
| Denitrogenation unit | | | | |
| Power of compressor K1 | kW | 7037 | 9383 | 14074 |
| Performance | | | | |
| Specific power of production of LNG | kJ/kg | 1019 | 1019 | 1019 |
| Ratio of power of K1/production of LNG 4 | | 0.0210 | 0.0210 | 0.0210 |

The installation depicted schematically in FIG. 3 is an LNG denitrogenation unit with a denitrogenation column. Replacing the flash in the vessel V1 with a denitrogenation column C1 allows an appreciable improvement in the efficiency with which the nitrogen contained in the LNG 1 is extracted.

In this installation, the LNG 1 at −145.5° C. is expanded to 5 bar in the expansion hydraulic turbine X3, then is cooled from −146.2° C. to −157° C. in the exchanger E2 by exchange of heat with the liquid flowing through the column bottom reboiler 16 to obtain an expanded and cooled LNG stream 20. The stream 20 undergoes a second expansion to 1.15 bar in a valve 21 and feeds into the denitrogenation column C1 as a mixture with the LNG 22 from the partial recycling of the compressed fuel gas 5.

At the bottom of the denitrogenation column C1, the LNG contains 0.06% nitrogen, whereas the nitrogen content of the LNG using a final flash was 1.38% (FIG. 2 and table 5). This column bottom LNG is pumped by a pump P1 and represents a cooled LNG fraction 4 which is sent for storage.

The fuel gas 3, which is the first top fraction from the column C1, is heated to −75° C. in the exchanger E1, then compressed to 29 bar in the compressor K1 and cooled by the water coolers 31–34 to provide a compressed fuel gas 5.

A stream 6, which represents 23% of the compressed gas 5 is recycled to the column C1 after the heating of the stream 3 in the exchanger E1.

The fuel gas produced, which represents 1032 GJ/h in the case of the use of one GE6 turbine and one GE7 turbine, is roughly identical in terms of total calorific value to that of the final flash unit of FIG. 2. The same is true when using more substantial LNG production units (2 or 3 GE7s).

The use of the technique of removing nitrogen in a denitrogenation column has made it possible to increase by 5.62% the capacity of the liquefication process, for a minor on-cost.

It must be understood that it is the combination of use of a denitrogenation column C1 and of the recycling of fuel gas which leads to this highly encouraging result.

The power of the fuel gas compressor K1 depends on the size of the unit. It will be:

8087 kW for an LNG unit using 1 GE6 combined with 1 GE7, 10783 kW for an LNG unit using 2 GE7s, 16174 kW an LNG unit using 3 GE7s.

The powers of these machines and the start-up problems mean that it is desirable to use a gas turbine to drive the fuel gas compressor K1. The other performance data for the method are given in table 6:

TABLE 6

| | Units | 1 GE7 + 1 GE6 | 2 GE7 | 3 GE7 |
|---|---|---|---|---|
| LNG 1 | | | | |
| Temperature | ° C. | −145.5 | −145.5 | −145.5 |
| Flow rate | kg/h | 428175 | 570899 | 856350 |
| Cooled LNG 4 | | | | |
| Flow rate | kg/h | 381659 | 508877 | 763318 |
| Specific lower heat value | kJ/kg | 49434 | 49434 | 49434 |
| Nitrogen content | mol % | 0.06 | 0.06 | 0.06 |
| Production of LNG 4, lower heat value | GJ/h % | 18867<br>105.62 | 25156<br>105.62 | 37734<br>105.62 |
| Fuel gas 5 | | | | |
| Flow rate | kg/h | 46517 | 62023 | 93034 |
| Specific lower heat value | kJ/kg | 22191 | 22191 | 22191 |
| Production of fuel gas 5, specific lower heat value | GJ/h | 1032 | 1376 | 2065 |
| Denitrogenation unit | | | | |
| Power of compressor K1 | kW | 8087 | 10783 | 16174 |
| Performance | | | | |
| Specific power of production of LNG | kJ/kg | 995 | 995 | 995 |
| Ratio of power of K1/production of LNG 4 | | 0.0201 | 0.0201 | 0.0201 |
| Additional production of LNG | kg/h<br>GJ/h | 12669<br>1003 | 16892<br>1338 | 25338<br>2007 |

One of the main problems encountered in industrial installations for treating and liquefying gases is related in particular to the optimum use of the compression apparatus which represents a significant investment, both in terms of initial purchase and in terms of power consumption. Indeed, compressors requiring power of the order of several tens of thousand kW need to be reliable and to be able to be used under conditions of optimum efficiency over the broadest possible range of loads. Of course, this comment also applies to the means used to run them, these means here usually being gas turbines, because of the commercially available range of powers.

Gas turbines in order to be efficient, need to be used at full capacity. Consider the example of a denitrogenation unit operating according to any one of the embodiments described in FIGS. 2 and 3. The gas turbine driving the compressor K1 needs to have a maximum power tailored to the power required by the compressor, so as to obtain the most favorable possible compression efficiency.

However, a gas turbine may find itself operating under conditions such that the power delivered to the compressor is markedly below its capacity.

This is the case for example when a GE5d gas turbine, with a power of 24000 kw, is coupled to the compressor K1 when nitrogen is being removed by final flash or by separation in a column. The consequence of this underuse of the turbine is a reduction in the energy efficiency of the compression stage relative to the power consumption of the turbine.

Of course, the power of the compressor K1 varies according to the size of the unit, as was explained above. Thus, the use of a GE5d turbine makes it possible to enjoy excess power amounting to:

15913 kW for an LNG unit using 1 GE6 turbine associated with 1 GE7 turbine, 13217 kW for an LNG unit using 2 GE7 turbines, 7826 kW for an LNG unit using 3 GE7 turbines.

It is therefore desirable to use this excess available power. The method according to the invention in particular proposes to use all of the available power to drive the compressor K1.

The method according to the invention also makes it possible to increase the temperature at the outlet of the liquefication method, to obtain the LNG stream 1, and to use the excess power available on the gas turbine driving K1 to cool the LNG to −160° C.

Furthermore, the method according to the invention makes it possible, because of the possibility of increasing the temperature of the LNG 1 produced for example according to the APCI method, to increase the flow rate of LNG cooled to −160° C. substantially, to an extent which in some cases may be by about 40%.

The method of the invention has the merit that it can be implemented easily, because of the simplicity of the means needed to embody it.

One embodiment according to the method of the invention, employing a denitrogenation column C1, is set out in FIG. 4, described above. For the same turbine power driving the compressor K1, the operating conditions will depend on the capacity of the natural gas liquefication unit.

An LNG 1 is produced at −140.5° C. using the APCI method depicted in FIG. 1. This method is implemented using two GE7 gas turbines to drive the compressors K2 and K3. The LNG 1 enters the installation set out in FIG. 4. It is expanded to 6.1 bar in the expansion hydraulic turbine X3 driving an electric generator, then cooled from −141.2 to −157° C. in a heat exchanger E2 by exchange of heat with a liquid passing through a column bottom reboiler 16 to provide a cooled LNG 21. The latter is expanded to 1.15 bar in a valve 21 to obtain an expanded stream 2 which is fed into a column C1 as a mixture with a stream 22, as indicated above in the description of the figures.

The LNG stream 4, tapped off at the bottom of the column C1, contains 0.00% nitrogen.

The fuel gas 3 is heated to −34° C. in the exchanger E1, then is compressed to 29 bar in the compressor K1 to feed into a fuel gas network.

A first difference compared with the known method stems from the amount of compressed gas 6 tapped off the fuel gas stream 5: this is now up to about 73%. This compressed gas 6 is compressed to 38.2 bar in the compressor XK1 to provide a fraction 7. The latter is cooled to 37° C. in a water exchanger 24 then split into two flows 8 and 9.

The flow 8, which is the larger flow, representing 70% of the stream 7, is cooled to −82° C. by passing through the exchanger E1, then is fed to the turbine X1, coupled to the compressor XK1. The expanded stream leaving the turbine 10, at a pressure of 9 bar and a temperature of −138° C., is heated in the exchanger E1 to 32° C. then fed into the compressor K1 at a medium-pressure stage 11 which is the third stage.

The flow 9, which is the smaller flow, representing 30% of the stream 7, is liquefied and cooled to −160° C. and returns to the denitrogenation column C1.

The fuel gas produced represents 1400 GJ/h, and is identical in total calorific value to that of the final flash unit. The use of the denitrogenation technique and of the method of the invention has made it possible to increase by 11.74% the capacity of the liquefication sequence, for a reasonable on-cost.

It must be understood that it is the combination of the use of a denitrogenation column, of the recycling of the compressed fuel gas and of the expansion turbine cycle which leads to this highly surprising result.

For the other sizes of LNG production unit, the results are given in table 7:

TABLE 7

| | Units | 1 GE7 + 1 GE6 | 2 GE7 | 3 GE7 |
|---|---|---|---|---|
| LNG 1 | | | | |
| Temperature | ° C. | −138.5 | −140.5 | −143.5 |
| Flow rate | kg/h | 462359 | 602827 | 875470 |
| Cooled LNG 4 | | | | |
| Flow rate | kg/h | 413619 | 537874 | 781438 |
| Specific lower heat value | kJ/kg | 49479 | 49479 | 49479 |
| Nitrogen content | mol % | 0.00 | 0.00 | 0.00 |
| Production of LNG 4, lower heat value | GJ/h % | 20465<br>114.57 | 26613<br>111.74 | 38661<br>108.21 |
| Fuel gas 5 | | | | |
| Flow rate | kg/h | 48713 | 64994 | 94055 |
| Specific lower heat value | kJ/kg | 21008 | 21535 | 21521 |
| Production of fuel gas 5, specific lower heat value | GJ/h | 1023 | 1400 | 2024 |
| Denitrogenation unit | | | | |
| Power of compressor K1 | kW | 23963 | 23970 | 23990 |
| Power of expander X1 | kW | 2835 | 2058 | 1175 |
| Performance | | | | |
| Specific power of production of LNG | kJ/kg | 1056 | 1030 | 983 |
| Ratio of power of K1/production of LNG 4 | | 0.0213 | 0.0208 | 0.0199 |
| Additional production of LNG | kg/h<br>GJ/h | 44629<br>2602 | 45889<br>2795 | 43458<br>2934 |

It can be seen that the increases in capacity are by:

14.2% for an LNG unit using one GE7 turbine associated with one GE6 turbine, 11.7% for an LNG unit using two GE7 turbines, 8.21% for an LNG unit using three GE7 turbines.

The method according to the invention also has a considerable benefit in regulating the amount of fuel gas produced. Indeed, it is now possible to have sustained production of fuel gas, as shown in a numerical example in table 8 below:

TABLE 8

| | Units | 2 GE7 |
|---|---|---|
| LNG 1 | | |
| Temperature | ° C. | −135 |
| Flow rate | kg/h | 641176 |
| Cooled LNG 4 | | |
| Flow rate | kg/h | 546088 |
| Specific lower heat value | kJ/kg | 49454 |
| Nitrogen content | mol % | 0.00 |
| Production of LNG 4, lower heat value | GJ/h % | 27006<br>113.39 |
| Fuel gas 5 | | |
| Flow rate | kg/h | 95092 |
| Specific lower heat value | kJ/kg | 29361 |
| Production of fuel gas 5, specific lower heat value | GJ/h | 2792 |
| Denitrogenation unit | | |
| Power of compressor K1 | kW | 23900 |
| Power of expander X1 | kW | 802 |
| Performance | | |
| Specific power of production of LNG 4 | kJ/kg | 1014 |
| Ratio of power of K1/production of LNG 4 | | 0.0205 |
| Additional production of LNG | kg/h<br>GJ/h | 54103<br>3188 |

It can be seen that when the amount of fuel gas rises from 1400 to 2800 GJ/h, it is then possible to increase the capacity by 13.39%, that is to say that 1.65% increase in capacity (13.39% minus 11.74%) are due to the increase in production of fuel gas.

Another embodiment according to the method of the invention, employing a denitrogenation column C1, is set out in FIG. 5 described above. Unlike in FIG. 4, this embodiment employs a separating vessel V2.

The LNG 1, of composition "B" obtained at −140.5° C. under a pressure of 48.0 bar with a flow rate of 33294 kmol/h, is expanded to 6.1 bar and minus 141.25° C. in the hydraulic turbine X3, then expanded again to 5.1 bar and −143.39° C. in the valve 18, to provide the expanded stream 2.

The stream 2 (33294 kmol/h) is mixed with the stream 35 (2600 kmol/h) to obtain the stream 36 (35894 kmol/h) at −146.55° C.

The stream 35 is made up of 42.97% nitrogen, 57.02% methane and 0.01% ethane.

The stream 36, which is made up of 6.79% nitrogen, 85.83% methane, 4.97% ethane, 1.71% propane, 0.27% isobutane and 0.44% n-butane, is separated in the vessel 2 into the second top fraction 12 (1609 kmol/h) and the second bottom fraction 13 (34285 kmol/h).

The stream 12 (45.58% nitrogen, 54.4% methane and 0.02% ethane) is heated to 33° C. in the exchanger E1 to provide a stream 37 fed, at 4.9 bar, to the compressor K1 to the medium-pressure stage 14.

The stream 13 (4.97% nitrogen, 87.30% methane, 5.20% ethane, 1.79% propane, 0.28% isobutane and 0.46% n-butane) is cooled in the heat exchanger E2 to provide the stream 20 at −157° C. and 4.6 bar. This stream is expanded in the valve 28 to obtain the stream 29 at −165.21° C. and 1.15 bar, which is introduced into the column C1.

The column C1 produces, at the top, the first top fraction 3 (4032 kmol/h) at −165.13° C. The fraction 3 (41.73% nitrogen and 58.27% methane) is heated in the exchanger E1 to give the stream 41 at −63.7° C. and 1.05 bar. The stream 41 is fed into the low-pressure suction side 15 of the compressor K1.

The column C1 produces the first bottom fraction 4 at −159.01° C. and 1.15 bar with a flow rate of 30253 kmol/h. This fraction 4 (0.07% nitrogen, 91.17% methane, 5.90% ethane, 2.03% propane, 0.32% isobutane and 0.52% n-butane) is pumped by the pump P1 to provide a fraction 39 at 4.15 bar and −158.86° C., then leaves the installation.

The column C1 is equipped with the column bottom reboiler 16 which cools the stream 13 to obtain the stream 20.

The compressor K1 produces the compressed flow 5 at 37° C. and 29 bar with a flow rate of 11341 kmol/h. This stream of fuel gas 5 (42.90% nitrogen and 57.09 methane) is split into a stream 40, which represents 3041 kmol/h, which leaves the installation, and a stream 6, which represents 8300 kmol/h, which is compressed in the compressor XK1.

The compressor XK1 products the compressed stream 7 at 68.18° C. and 39.7 bar. The stream 7 is cooled to 37° C. in the water exchanger 24, then split into the streams 8 and 9.

The stream 8 (5700 kmol/h) is cooled in the exchanger E1 to yield the stream 25 at −74° C. and 38.9 bar.

The stream 9 (2600 kmol/h) is cooled in the exchanger E1 to yield the stream 22 at −155° C. and 38.4 bar. The latter is then expanded in the valve 23 to provide the stream 35 at −168° C. and 5.1 bar.

The stream 25 is expanded in the expansion turbine X1 which produces the fraction 10 at a temperature of −139.7° C. and a pressure of 8.0 bar. This fraction 10 is then heated in the exchanger E1 which produces the fraction 26 at a temperature of 32° C. and a pressure of 7.8 bar.

The fraction 26 is fed to the compressor K1 on the medium-pressure stage 11. The compressor K1 and the expander X1 have the following performance:

| Denitrogenation unit | |
|---|---|
| Power of compressor K1 | 22007 kW |
| Power of expander X1 | 2700 kW |

The use of the vessel V2 allows a saving of about 2000 kW on the power of the compressor K1.

From these studies on the nitrogen-rich gas B, it is evident from the method according to the invention that:

- the increase in temperature of the LNG leaving the liquefication method makes it possible to obtain an increase in LNG production capacity of 1.2% per ° C.,
- the use of a denitrogenation column associated with liquefication of some of the fuel gas produced is far more effective than a final flash,
- saturation of the power of the gas turbine coupled to the compressor K1 by use of the novel method makes it possible to achieve a significant gain in LNG production capacity,
- the increase in the amount of fuel gas produced makes it possible to obtain an additional increase in the LNG production capacity,
- the addition of the separating vessel V2 makes it possible to improve the load on the compressor K1 and to lower the cost of its use.

The following study relates to the use of the nitrogen-depleted gas A, in which the final flash unit produces no fuel gas.

In a known way, natural gas containing very little nitrogen does not require the use of a final flash.

The LNG can then be produced directly at −160° C. and be sent for storage after expansion in a hydraulic turbine, for example similar to X3: this is the highly supercooled approach.

When the highly supercooled technique is chosen the sources of fuel gas may be various:

- gas from the top of the methane remover,
- gas from the top of the condensate stabilization column,
- gas from the evaporation in the storage tanks,
- gas from regeneration of the natural gas dryers, etc.

It is then no longer possible to add a source of fuel gas without running the risk of having excess fuel gas. If there is a desire to increase the capacity of the LNG production line by increasing the temperature of the LNG produced using the liquefication method, it is necessary to set up a method that produces little or no fuel gas.

The method according to the invention makes it possible to achieve this objective. It makes it possible to increase the temperature of the LNG leaving the liquefication method and therefore to increase the flow rate of cooled LNG 4, produced for storage purposes.

This method is set out in FIG. 6, and was described above. For the same power of turbine coupled to the compressor K1, the operating conditions-will depend on the capacity of the liquefication unit. The case of the use of LNG 1 from an LNG production unit comprising 2 GE7 turbines is described hereinafter by way of example:

The LNG 1 at a temperature of −147° C. is expanded to 2.7 bar in the hydraulic turbine X3 driving an electric generator, then undergoes a second expansion to 1.15 bar in the valve 18, and is fed to the flash vessel V1, in a mixture with LNG from the liquefication of the compressed fuel gas 5.

At the bottom of the vessel V1, the LNG is at −159.2° C. and 1.15 bar. It then leaves the installation and goes for storage.

The fuel gas 3, which is the first top fraction, is heated to 32° C. in the exchanger E1 before being compressed to 29 bar in the compressor K1, to possibly feed into the fuel gas network. In this instance, all of the fuel gas is sent to the compressor XK1 to provide the compressed stream 7 at 41.5 bar. This stream is then cooled to 37° C. in the water exchanger 24, and is then split into two flows 8 and 9.

The stream 8, which represents 79% of the stream 7, is cooled to −60° C. before being fed to the turbine X1 coupled to the compressor XK1. The turbine X1 provides the expanded gas 10, at a pressure of 9 bar and a temperature of −127° C. This stream 10 is heated in the exchanger E1 to obtain a heated stream 26, at 32° C., then fed into the compressor K1 on the suction side of its third stage.

The stream 9, which represents 21% of the stream 7, is liquefied and cooled to −141° C. in the exchanger E1 and returns to the flash vessel V1.

The use of the novel method has made it possible to increase by 15.82% the capacity of the liquefication sequence, for a reasonable on-cost.

It must be understood that it is the combination of the recycling of the compressed fuel gas and of the expansion turbine cycle which leads to this highly surprising result.

For LNG production units of different size, the results are given in:

table 9, which corresponds to the characteristics of a unit operating according to the embodiment of the method of the invention as set out in FIG. 6, table 10, given by way of comparison, which sets out the characteristics of an LNG refrigeration unit using the highly supercooled approach.

TABLE 9

| | Units | 1 GE7 + 1 GE6 | 2 GE7 | 3 GE7 |
|---|---|---|---|---|
| LNG 1 | | | | |
| Temperature | ° C. | −144 | −147 | −151 |
| Flow rate | kg/h | 430862 | 556506 | 799127 |
| Cooled LNG 4 | | | | |
| Flow rate | kg/h | 430862 | 556506 | 799127 |
| Specific lower heat value | kJ/kg | 49334 | 49334 | 49334 |
| Nitrogen content | mol % | 0.10 | 0.10 | 0.10 |
| Production of LNG 4, lower heat value | GJ/h % | 21256<br>100 | 27455<br>115.82 | 39424<br>110.87 |
| Fuel gas 5 | | | | |
| Flow rate | kg/h | 0 | 0 | 0 |
| Specific lower heat value | kJ/kg | 0 | 0 | 0 |
| Production of fuel gas 5, specific lower heat value | GJ/h | 0 | 0 | 0 |
| Final flash unit | | | | |
| Power of compressor K1 | kW | 24000 | 24000 | 23543 |
| Power of expander X1 | kW | 4719 | 4719 | 4850 |
| Performance | | | | |
| Specific power of production of LNG 4 | kJ/kg | 1014 | 995 | 984 |
| Ratio of power of K1/production of LNG 4 | | 0.0206 | 0.0202 | 0.0199 |
| Additional production of LNG | kg/h<br>GJ/h | 70489<br>3477 | 76010<br>3749 | 78381<br>3866 |

TABLE 10

| | Units | 1 GE7 + 1 GE6 | 2 GE7 | 3 GE7 |
|---|---|---|---|---|
| LNG 1 | | | | |
| Temperature | ° C. | −160 | −160 | −160 |
| Flow rate | kg/h | 360373 | 480496 | 720746 |
| Cooled LNG 4 | | | | |
| Flow rate | kg/h | 360373 | 480496 | 720746 |
| Specific lower heat value | kJ/kg | 49334 | 49334 | 49334 |
| Nitrogen content | mol % | 0.10 | 0.10 | 0.10 |
| Production of LNG 4, lower heat value | GJ/h % | 17779<br>100.00 | 23705<br>100.00 | 35558<br>100.00 |
| Fuel gas 5 | | | | |
| Flow rate | kg/h | 0 | 0 | 0 |
| Specific lower heat value | kJ/kg | 0 | 0 | 0 |
| Production of fuel gas 5, specific lower heat value | GJ/h | 0 | 0 | 0 |

TABLE 10-continued

| | Units | 1 GE7 + 1 GE6 | 2 GE7 | 3 GE7 |
|---|---|---|---|---|
| Final flash unit | | | | |
| Power of compressor K1 | kW | 0 | 0 | 0 |
| Power of expander X1 | kW | 0 | 0 | 0 |
| Performance | | | | |
| Specific power of production of LNG 4 | kJ/kg | 973 | 973 | 973 |
| Ratio of power of K1/production of LNG 4 | | 0.0197 | 0.0197 | 0.0197 |
| Additional production of LNG | kg/h<br>GJ/h | 0<br>0 | 0<br>0 | 0<br>0 |

The increases in capacity for the use of an installation according to the method of the invention, by comparison with the highly supercooled approach, are as follows:

19.6% for an LNG unit using 1 GE6 turbine associated with one GE7 turbine, 15.8% for an LNG unit using 2 GE7 turbines, 10.9% for an LNG unit using 3 GE7 turbines.

The embodiment of the method according to the invention according to FIG. 6 also allows the production of fuel gas, when this is desired. This eventuality is illustrated in a numerical example in table 11 below:

TABLE 11

| | Units | 1 GE7 + 1 GE6 |
|---|---|---|
| LNG 1 | | |
| Temperature | ° C. | −143 |
| Flow rate | kg/h | 583534 |
| Cooled LNG 4 | | |
| Flow rate | kg/h | 567402 |
| Specific lower heat value | kJ/kg | 49351 |
| Nitrogen content | mol % | 0.06 |
| Production of LNG 4, lower heat value | GJ/h % | 28002<br>118.13 |
| Fuel gas 5 | | |
| Flow rate | kg/h | 16132 |
| Specific lower heat value | kJ/kg | 48659 |
| Production of fuel gas 5, specific lower heat value | GJ/h | 785 |
| Final flash unit | | |
| Power of compressor K1 | kW | 23888 |
| Power of expander X1 | kW | 3520 |
| Performance | | |
| Specific power of production of LNG 4 | kJ/kg | 976 |
| Ratio of power of K1/production of LNG 4 | | 0.0198 |
| Additional production of LNG | kg/h<br>GJ/h | 86906<br>4297 |

When the production of fuel gas rises from 0 to 785 GH/h, it is then possible to increase the capacity by 18.13%, that is to say that 2.31% of the increase in capacity (18.13% minus 15.82%) are due to the production of fuel gas. This result is far more pronounced than the one obtained with a denitrogenation installation.

Another embodiment according to the method of the invention, employing a denitrogenation column C1, is set out in FIG. 7, described above. Unlike in FIG. 6, this embodiment uses a separating vessel V2.

The LNG 1, of composition "A" obtained at −147° C. at a pressure of 48.0 bar with a flow rate of 30885 kmol/h, is expanded to 2.7 bar and minus 147.63° C. in the hydraulic turbine X3, then is expanded again to 2.5 bar and minus 148.33° C. in the valve 18, to provide the expanded stream 2.

The stream 2 (30885 kmol/h) is mixed with the stream 35 (3127 kmol/h) to obtain the stream 36 (34012 kmol/h) at −149.00° C.

The stream 35 is made up of 3.17% nitrogen, 96.82% methane and 0.01% ethane.

The stream 36, which is made up of 0.38% nitrogen, 91.90% methane, 4.09% ethane, 2.27% propane, 0.54% isobutane and 0.82% n-butane, is separated in the vessel V2 into the second top fraction 12 (562 kmol/h) and the second bottom fraction 13 (33450 kmol/h).

The stream 12 (5.41% nitrogen, 94.57% methane and 0.02% ethane) is heated to 34° C. in the exchanger E1, to provide a stream 37 which is fed, at 2.4 bar, to the compressor K1 to the medium-pressure stage 14.

The stream 13 (0.03% nitrogen, 91.85% methane, 4.16% ethane, 2.31% propane, 0.55% isobutane and 0.83% n-butane) is expanded in the valve 28 to obtain the stream 29 at −159.17° C. and 1.15 bar, which is introduced into the separating vessel V1.

The vessel V1 produces, at the top, the first top fraction 3 (2564 kmol/h) at −159.17° C. The fraction 3 (2.72% nitrogen, 97.27% methane and 0.01% ethane) is heated in the exchanger E1 to give the stream 41 at minus 32.21° C. and 1.05 bar. The stream 41 is fed into the low-pressure suction side 15 of the compressor K1.

The vessel V1 produces the first bottom fraction 4 at −159.17° C. and 1.15 bar with a flow rate of 30886 kmol/h. This fraction 4 (0.10% nitrogen, 91.40% methane, 4.50% ethane, 2.50% propane, 0.60% isobutane and 0.90% n-butane) is pumped by the pump P1 to provide a fraction 39 at 4.15 bar and −159.02° C., then leaves the installation.

The compressor K1 produces the compressed stream 5 at 37° C. and 29 bar with a flow rate of 13426 kmol/h. This fuel gas stream 5 (3.18% nitrogen, 96.81% methane and 0.01% ethane) is compressed in full in the compressor XK1, without producing fuel gas 40.

The compressor XK1 produces the compressed stream 7 at 72.51° C. and 42.7 bar. The stream 7 is cooled to 37° C. in the water exchanger 24 and is then split into the streams 8 and 9.

The stream 8 (10300 kmol/h) is cooled in the exchanger E1 to give the stream 25 at −56° C. and 41.9 bar.

The stream 9 (3126 kmol/h) is cooled in the exchanger E1 to give the stream 22 at −141° C. and 41.4 bar. The latter stream is then expanded in the valve 23 to provide the stream 35 at −152.37° C. and 2.50 bar.

The stream 25 is expanded in the expansion turbine X1 which produces the fraction 10 at a temperature of −129.65° C. and a pressure of 8.0 bar. This fraction 10 is then heated in the exchanger E1 which produces the fraction 26 at a temperature of 34° C. and a pressure of 7.8 bar.

The fraction 26 is fed into the compressor K1 on the suction side of the medium-pressure stage 11. The compressor K1 and the expander X1 have the following performance:

| Denitrogenation unit K1 | |
|---|---|
| Power of compressor K1 | 23034 kW |
| Power of expander X1 | 2700 kW |

The use of the vessel V2 allows a saving of about 1000 kW on the power of the compressor K1.

Finally, from these studies on gas A, which is nitrogen-depleted, it is evident from the method according to the invention that:

- the increase in the temperature of the LNG leaving the liquefication method makes it possible to obtain an increase in LNG production capacity of 1.2% per ° C., this result being identical to the one obtained with gas A,
- the use of a final flash (vessel V1) and the saturation of the power of the gas turbine driving the compressor K1 makes it possible, by virtue of the method of the invention, to obtain a significant gain in LNG production capacity, without producing fuel gas,
- the production of fuel gas makes it possible to obtain an increase in the LNG production capacity. This gain is not insignificant and may prove to be a decisive factor,
- the addition of the separating vessel V2 makes it possible to improve the load on the compressor K1 and to reduce the cost of using it.

What is claimed is:

1. A method for refrigerating a pressurized liquefied natural gas, wherein the gas contains methane, $C_2$ and higher hydrocarbons, the method comprising:

(Ia) expanding the pressurized liquefied natural gas to provide an expanded liquefied natural gas stream;

(Ib) splitting the expanded liquefied natural gas stream into a relatively more volatile first top fraction and a relatively less volatile first bottom fraction comprised of refrigerated liquefied natural gas;

(Ic) collecting the first bottom fraction comprised of refrigerated liquefied natural gas;

(Id) heating the first top fraction, compressing the heated first top fraction by a first compression step and then cooling the compressed top fraction for providing a first fuel gas compressed fraction, and collecting the first fuel gas compressed fraction;

(Ie) tapping off a second compressed fraction from the first compressed fraction, cooling the second compressed fraction and then mixing the cooled second compressed fraction with the expanded liquefied natural gas stream;

(IIa) compressing the second compressed fraction in a second compression step which is coupled to an expansion turbine for providing a third compressed fraction;

(IIb) cooling the third compressed fraction; splitting the third compressed fraction into a fourth compressed fraction and a fifth compressed fraction;

(IIc) cooling the fourth compressed fraction and expanding the fourth compressed fraction in the expansion turbine coupled to the second compression step for providing an expanded fraction, and heating the expanded fraction; introducing the expanded fraction into a medium-pressure first stage of the first compression; and (IId) cooling the fifth compressed fraction and then mixing the cooled fifth compressed fraction with the expanded liquefied natural gas stream.

2. The method of claim 1, wherein prior to step (Ib), splitting the expanded liquefied natural gas stream into a second top fraction and a second bottom fraction;

heating the second top fraction, then introducing the heated second top fraction into the first compression step in an intermediate medium-pressure second stage between the medium-pressure first stage and a low-pressure stage;

splitting the second bottom fraction into the first top fraction and the first bottom fraction.

3. The method of claim 1, further comprising cooling each gas fraction after each of the respective compression steps.

4. A refrigerated liquefied natural gas obtained by performing the method of claim 1.

5. Apparatus for refrigerating a pressurized liquefied natural gas, wherein the gas contains methane, $C_2$ and higher hydrocarbons, the apparatus comprising:

(Ia) first means for expanding the pressurized liquefied natural gas for providing an expanded liquefied natural gas stream;

(Ib) second means for splitting the expanded liquefied natural gas into a relatively more volatile first top fraction and a relatively less volatile first bottom fraction;

(Ic) a first collector for collecting the first bottom fraction comprised of refrigerated liquefied natural gas;

(Id) a heater for heating the first top fraction, a first compressor for compressing the heated top fraction and first cooling means for cooling the compressed top fraction for providing a fuel gas compressed fraction, and a second collector for collecting the fuel gas compressed fraction;

(Ie) a tap for tapping off the fuel gas compressed fraction from the second collector for providing a second compressed fraction; second cooling means for cooling the second compressed fraction and a mixer for mixing the second compressed fraction with the expanded liquefied natural gas stream;

(IIa) a second compressor for receiving the second compressed fraction and for compressing the second compressed fraction, an expansion turbine coupled to the second compressor for providing a third compressed fraction from the compressor;

(IIb) a first cooler for cooling the third compressed fraction; means for splitting the third compressed fraction into a fourth compressed fraction and a fifth compressed fraction;

(IIc) a second cooler for cooling the fourth compressed fraction and communicating the fourth compressed fraction to the expansion turbine coupled to the second compressor for providing an expanded fraction; a heater for heating the expanded fraction; the first compressor having a medium-pressure first stage into which the heated expanded fraction is communicated;

(IId) a third cooler for cooling the fifth compressed fraction and a mixer for receiving the fifth compressed fraction and mixing the fifth compressed fraction with the expanded liquefied natural gas stream.

6. The apparatus of claim 5, further comprising:

a means for splitting the expanded liquefied natural gas stream into a second top fraction and a second bottom fraction prior to (Ib) the second means for splitting;

means for heating and then for introducing the second top fraction into the first compressor in an intermediate medium-pressure second stage between the medium-pressure first stage and a low-pressure stage; and means for splitting the second bottom fraction into the first top fraction and the first bottom fraction.

7. The apparatus of claim 6, further comprising a first separating vessel for separating the first top fraction and the first bottom fraction.

8. The apparatus of claim 6, further comprising a distillation column for separating the first top fraction and the first bottom fraction.

9. The apparatus of claim 7, further comprising a separating vessel for splitting the expanded liquefied natural gas stream into the second top fraction and the second bottom fraction.

10. The apparatus of claim 8, wherein the distillation column comprises at least one of a lateral or a column-bottom reboiler; the distillation column having a plate and liquid is tapped off the plate of the distillation column and is connected to pass through the reboiler, a heat exchanger for heating the liquid passing through the reboiler, and a connection for reintroducing the heated liquid into the distillation column and a stage below the plate thereof; the expanded liquefied natural gas stream is communication with the heat exchanger to be cooled in the heat exchanger.

11. The apparatus of claim 10, wherein the heat exchanger is connected to the first, expanded, fourth and fifth compressed fractions for causing cooling of the first top fraction and of the expanded fraction and heating of the fourth and the fifth compressed fractions.

12. The apparatus of claim 11, wherein the heat exchanger communicates with a second top fraction for heating the second top fraction in the heat exchanger.

* * * * *